US007299835B2

(12) United States Patent
Dupont et al.

(10) Patent No.: US 7,299,835 B2
(45) Date of Patent: Nov. 27, 2007

(54) APPARATUS FOR TRANSFERRING A FLUID BETWEEN A TRANSPORT VESSEL AND A STORAGE STATION

(76) Inventors: Bernard Dupont, 176 Chausée Jules César, Eaubonne (FR) 95600; Stéphane Paquet, 7 rue de Vouillet, Paris (FR) 75015

( * ) Notice: Subject to any disclaimer, the term of this patent is extended or adjusted under 35 U.S.C. 154(b) by 264 days.

(21) Appl. No.: 10/493,965

(22) PCT Filed: Oct. 30, 2002

(86) PCT No.: PCT/FR02/03748

§ 371 (c)(1),
(2), (4) Date: Oct. 13, 2004

(87) PCT Pub. No.: WO03/037704

PCT Pub. Date: May 8, 2003

(65) Prior Publication Data

US 2005/0051237 A1 Mar. 10, 2005

(30) Foreign Application Priority Data

Oct. 30, 2001 (FR) ..... 01 14045

(51) Int. Cl.
*B65B 1/04* (2006.01)

(52) U.S. Cl. ..... 141/382; 141/231; 141/384; 141/387; 441/5; 114/230.23

(58) Field of Classification Search ..... 141/231, 141/234, 250, 285, 382–384, 386, 387, 59, 141/284; 441/3, 5; 114/258, 230.1, 230.2, 114/230.23

See application file for complete search history.

(56) References Cited

U.S. PATENT DOCUMENTS

| | | | | |
|---|---|---|---|---|
| 3,746,060 | A | 7/1973 | Janssen et al. | |
| 3,913,157 | A * | 10/1975 | Versluis et al. | 441/5 |
| 5,431,589 | A * | 7/1995 | Corona | 441/4 |
| 6,637,479 | B1 * | 10/2003 | Eide et al. | 141/387 |

FOREIGN PATENT DOCUMENTS

| | | |
|---|---|---|
| DE | 297 12 429 | 9/1997 |
| WO | WO 01/04041 | 1/2001 |
| WO | WO 01/34460 | 5/2001 |

* cited by examiner

*Primary Examiner*—Timothy L. Maust
(74) *Attorney, Agent, or Firm*—Leydig, Voit & Mayer, Ltd.

(57) ABSTRACT

An apparatus for transferring a fluid product between a fluid transport vessel and a storage vessel includes a tubular arrangement for conveying the fluid between the two vessels. The tubular arrangement includes a flexible transfer pipe hanging freely between ends in its transferring position and connected to a manifold of the transport vessel. Each of the ends of the transfer pipe has a pivoted connection with a vertical pin to avoid torsional stresses in the transfer pipe. The invention is useful to transferring liquefied natural gas.

15 Claims, 3 Drawing Sheets

APPARATUS FOR TRANSFERRING A FLUID BETWEEN A TRANSPORT VESSEL AND A STORAGE STATION

FIELD OF THE INVENTION

The invention concerns a system for transferring a fluid product, particularly liquefied natural gas, between a vessel for transport of the fluid and a storage station such as a storage vessel, of the type which has a tubular arrangement for conveying the fluid between the transport vessel and the storage station, one end of which is connected to the latter and the other end of which can be connected to a manifold device of the transport vessel.

BACKGROUND

Known transfer systems of this type have the major disadvantage of having a very complex structure but without the ability to function under severe environmental conditions involving extensive relative movement between the transport vessel and the storage station, particularly when this station is a storage vessel.

SUMMARY OF THE INVENTION

The present invention aims to mitigate these disadvantages and proposes a transfer system with a relatively simple structure which is suitable even for difficult environmental conditions, while allowing the transfer of liquefied natural gas.

In order to realize this aim, the transfer system according to the invention has a flexible transfer conduit freely suspended between its ends in its transfer position, connected to a manifold device of the transport vessel, and each of its ends has a rotating connection with a vertical axis to prevent torsional stresses in and buckling of the conduit.

According to another characteristic of the invention, the flexible conduit is formed by a hose such as a cryogenic hose, suitable for the transfer of a liquefied natural gas.

According to another characteristic of the invention, the transfer conduit is a sequence of elements articulated one to another.

According to another characteristic of the invention, the flexible transfer conduit is suspended in the form of a chain.

BRIEF DESCRIPTION OF DRAWING FIGURES

The invention will be better understood and other aims, characteristics, details and advantages thereof will appear more clearly in the following explanatory description in reference to the appended figures given only as examples and illustrating an embodiment of the invention.

DETAILED DESCRIPTION

Figure 1:
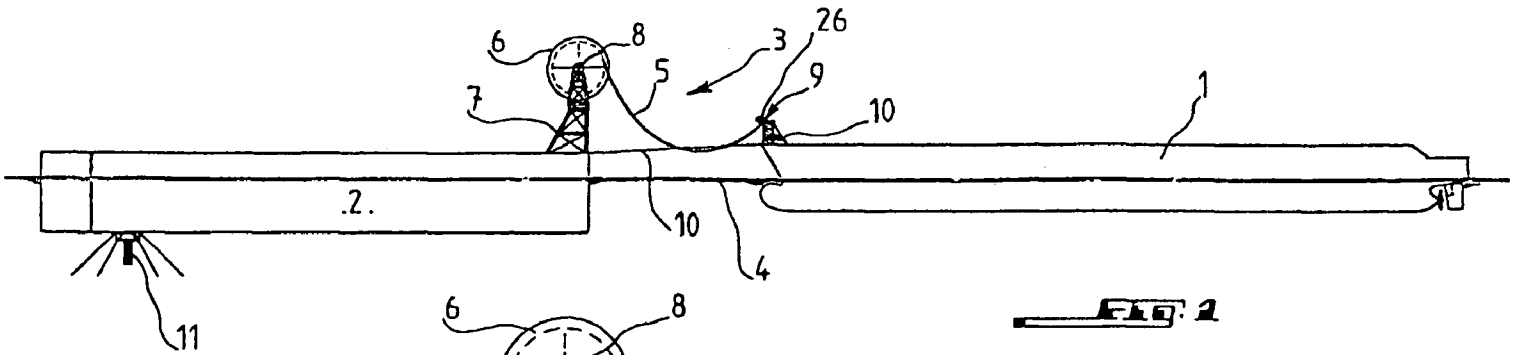
FIG. 1 is an elevation of a fluid transport system in its position for transfer of a fluid between a transport vessel and a storage vessel.
Figure 2:
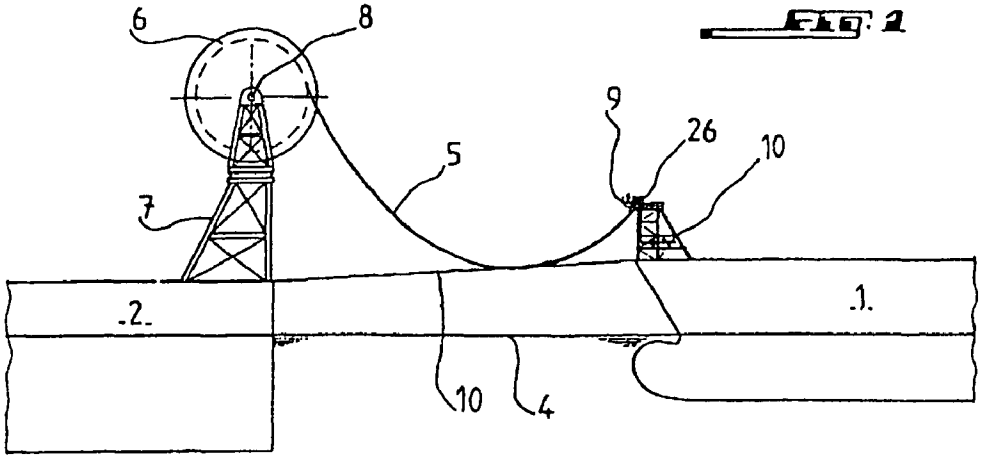
FIG. 2 is an enlarged view of the storage system indicated by 3 in FIG. 1.
Figure 3:
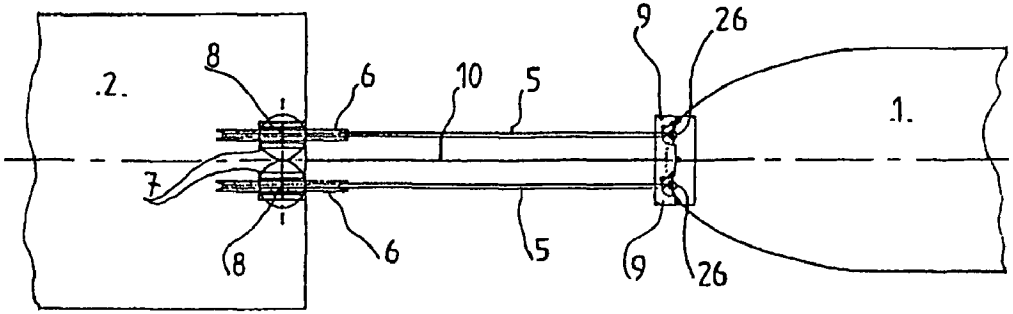
FIG. 3 is a top view of the transfer system according to FIG. 2.
Figure 5:
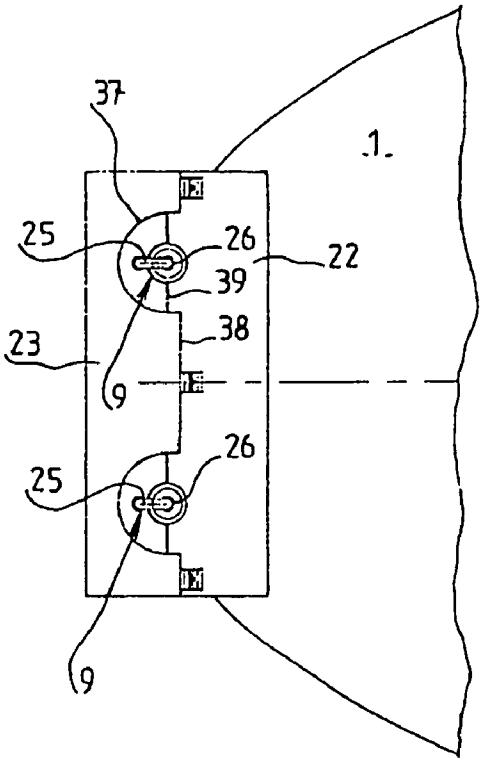
FIG. 5 is a top view on a larger scale of the front part of the vessel and of the manifold device.

In the figures, reference numbers 1, 2 and 3 respectively designate a vessel for transport of a product such as liquefied natural gas, a vessel for storage of this product and a system for transferring this product between the two vessels 1 and 2, in accordance with the invention. The number 4 indicates the water level.

In the example represented, the transfer system according to the invention essentially comprises two flexible fluid transfer conduits 5 which, in the rest state of the system, are wound on wheel 6 mounted on top of support structure 7 in the form of a turret mounted at one end of storage vessel 2. In the operating state, that is, in its position for transfer of a product between the two vessels, each conduit, advantageously formed by a cryogenic hose, is unwound from its storage wheel 6 and connected to manifold device 9 supported by common support structure 10 arranged at the front of transport vessel 1. Thus, each hose 5 extends freely in the form of a chain between its ends. It is also observed that transport vessel 1 is anchored to the storage vessel by any appropriate means, for example, by cable 10. In the example represented, storage vessel 2 is anchored and connected to the bottom at 11.

Figure 4:
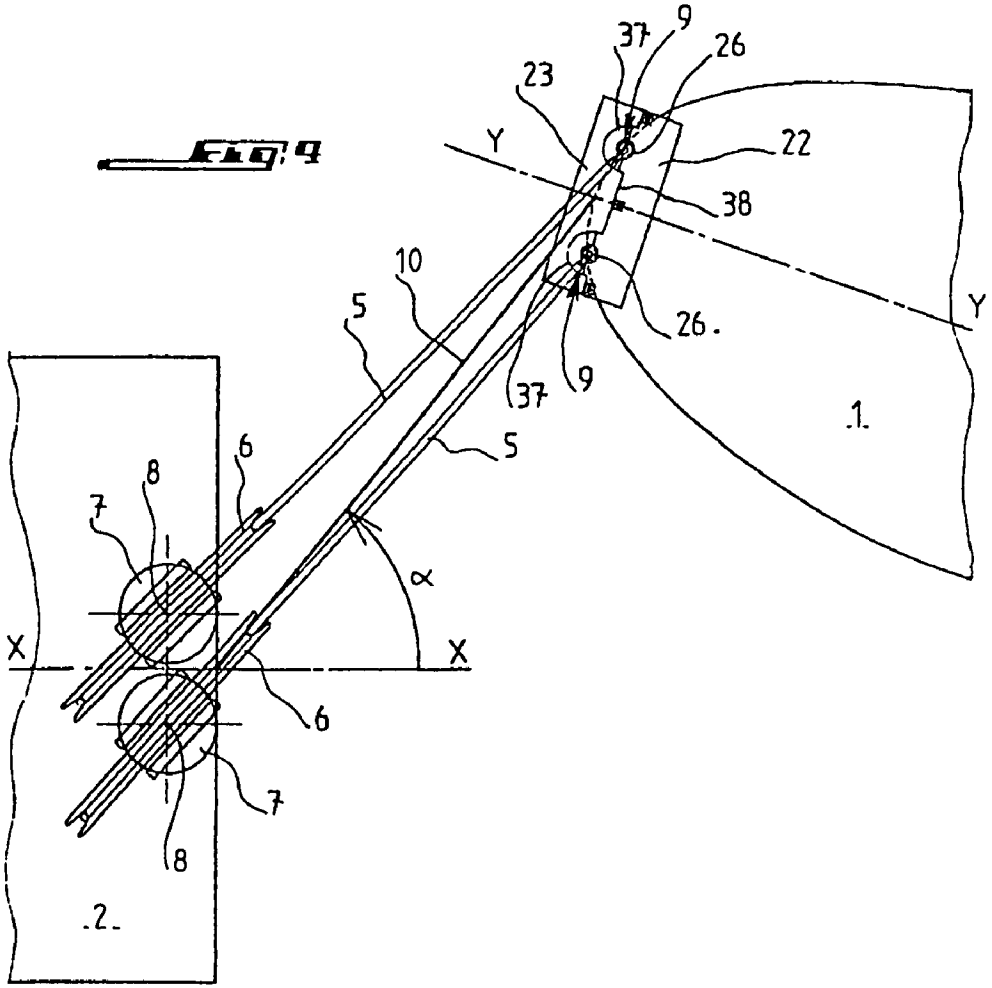
FIG. 4 is a view similar to FIG. 3 but on a larger scale, showing the two vessels in an unaligned position.

As shown in FIG. 4, the two storage wheels 6 for hose 5 are mounted to pivot over an angle □ on their support tower about a vertical axis in order to make possible the relative movement of transport vessel 1 and the storage vessel to prevent torsional stress to the hoses. This pivoting is ensured by a rotating shaft with a vertical axis indicated by 8. The two support turrets 7 can advantageously be arranged symmetrically with respect to the longitudinal axis X-X of the storage vessel. The longitudinal axis of the transport vessel is designated Y-Y.

The free end of cryogenic hose 5, designated by general reference 13, is formed by an endpiece bearing quick connector 14, with emergency disconnection device 15 arranged a certain axial distance from connector 14. Endpiece 13 moreover bears a centering rod called pin 17 which is laterally offset from the axis of the endpiece but which extends parallel to it approximately in the vertical plane formed by the catenary of the hose.

Provided for each cable 5, on the front of transport vessel 1, is manifold device 9 mounted on support structure 10 at a certain height, which bears two catwalks 22 and 23. The two catwalks are offset from the axis of the vessel, with a slight overlap, the front catwalk 23 being arranged above rear catwalk 22. The two catwalks are provided in order to allow operators to observe and/or maneuver the two manifold devices 9.

Each device 9 comprises curved tubular portion 25 in the form of an arc of a circle somewhat less than an angle of 180°. The rear end of portion 25 is attached by rotating connection 26 with a vertical axis to vertical pipeline portion 28 of the fixed pipeline of the vessel.

Curved portion 25 of the connection device, which is thus mounted to pivot, bears manifold flange 30 at its free end for the sealed attachment of connector 14 of the hose, as well as flared piece 32, which is laterally offset from the axis of the connector by a distance that makes possible, during connection of the hose to device 9, the reception of pin 17 of the connecting endpiece of the hose. The flared piece is oriented parallel to the axis of connector 30. Portion 25 of connecting device 9 of the vessel also bears winch 34, on which is wound cable 35. This cable will be unwound during connection of hose 5 to manifold device 9, passing through flared piece 32 and attaching to the end of pin 17. The connection is then completed by winding the cable on winch 34.

As seen clearly in the figures, in order to make possible the connection of hoses 5 to manifold devices 9 of the transport vessel, an approximately semicircular cut 37 is made in upper catwalk 23 from its rear edge 38, overlapping front edge 39 of lower catwalk 22, around the pivot axis of curved portions 25 of manifold devices 9, coaxially thereto.

Figure 7:
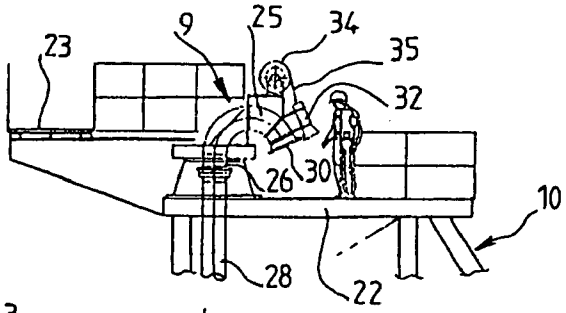
FIG. 7 is a view showing the exposed manifold device according to FIG. 6 and its support structure in the rest state.
Figure 6:
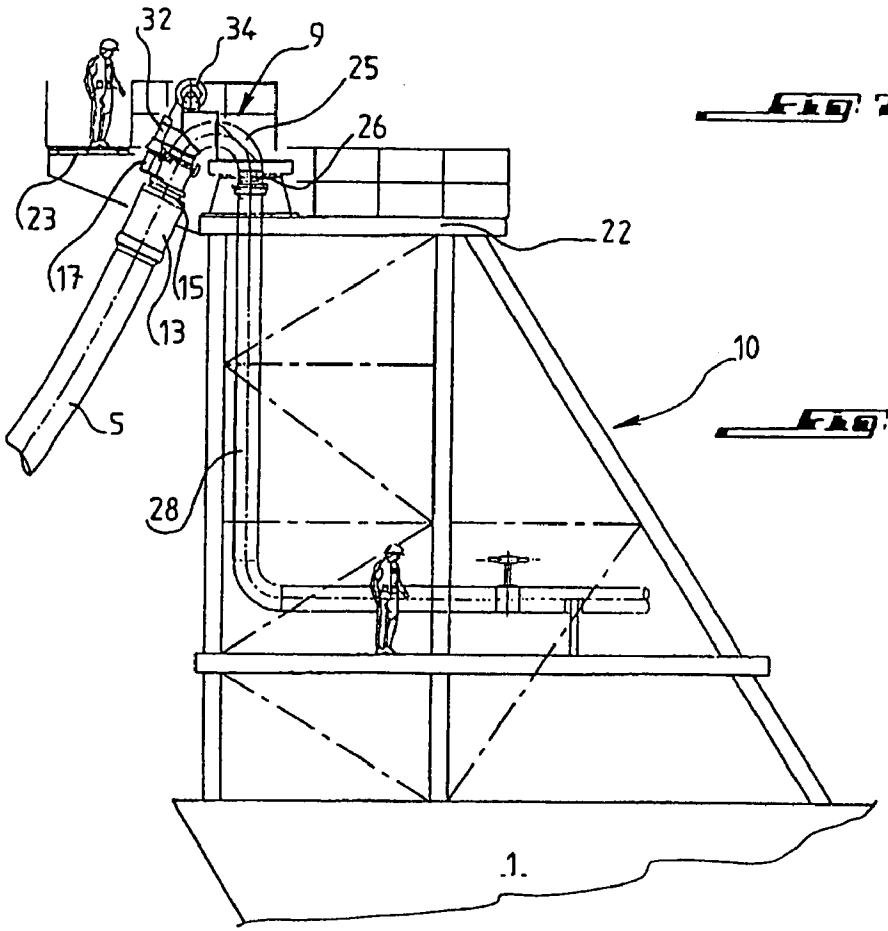
FIG. 6 is an elevation on a larger scale of the front part of a transport vessel provided with the manifold device in its position in which it is connected to the transfer conduit.

Thus, each manifold device 9 can pivot between its rest position, in which its connector 30 is above lower catwalk 29 (FIG. 7) and its operating position, that is, its connection position represented in FIG. 6, in which connector 30 passes through cut 37 so that it can be connected to hose 5. It is observed that the angle of arc of curved portion 25 of each connection device 19 is less than 180° with a difference allowing an appropriate inclination of the axis of manifold flange 30 for easy connection to the hose.

According to an important feature of the invention, and due to rotating connection 26 with vertical axis of each manifold device 9 of the vessel and to the vertical pivot axis of storage wheels 6, each cryogenic hose 5 suspended in catenary form comprises, at each end, a rotating connection with vertical axis ensuring that the hose always extends approximately in the vertical plane independently of the angle of misalignment a of the two vessels 1 and 2. This ensures great freedom of relative pitch and yaw between the vessels. Due to the rotating connections with vertical axis, the torsion and bending from the vertical plane of the hose catenary (buckling) in the hose are negligible. They are therefore only exposed to the very slight relative rolling between the vessels. For the safety of the hose, only one measurement or verification of the distance between the two ends of the hose is necessary.

The operation of the transfer system according to the invention follows from the figures and the description of the structure just given. It is sufficient to recall that for a transfer of liquefied natural gas between transport vessel 1 and storage vessel 2, at least one of cables 35 of the corresponding manifold device 9 will be unwound from its winch 34, and hose 5 will be unwound from its storage wheel 6, the end of cable 35 is attached to the end of pin 17 on endpiece 13 of the hose, cable 35 is wound on winch 34 until the pin engages in flared piece 32 of manifold device 9, which, of course, has been made to pivot from its storage position represented in FIG. 7 to its connection position according to FIG. 6.

It should also be noted that the hoses never cross the mooring cable, which is very important, particularly in case of emergency disconnection. Thus, the hoses cannot be damaged by falling on the cable. During disconnection, the hoses are wound on their storage wheel.

Figure 8:
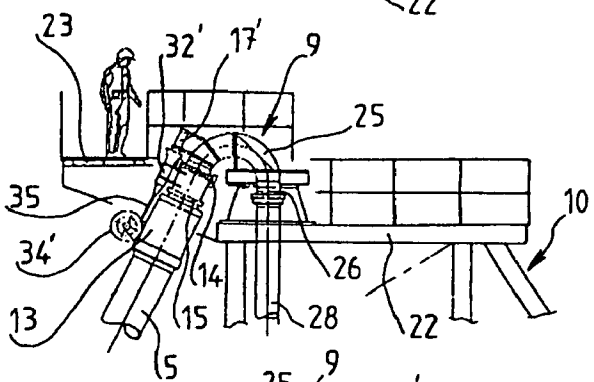
FIGS. 8 and 9 show another embodiment of the manifold device according to the invention respectively in its position in which it is connected to the transfer conduit and in its rest position.
Figure 9:
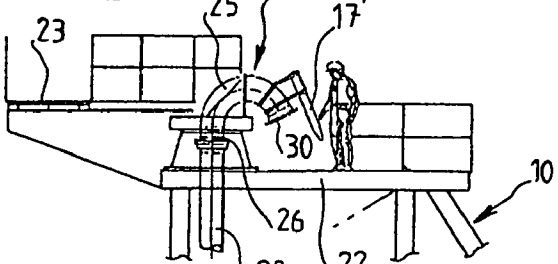

Of course, various modifications can be made to the system as described and represented in the figures. FIGS. 8 and 9 illustrate an embodiment variant, wherein the winch and the flared piece now bearing reference numbers 34' and 32', are provided on endpiece 13 of each hose, while the pin, now bearing reference number 17', is carried by manifold device 9. It would also be possible to consider other ways to implement the means for storing the hoses in their rest position. In any embodiment considered, it is only important for a rotating connection with vertical axis to be provided at each end of the hose so that the hose is not subjected to torsional stresses and buckling. These stresses are absorbed by the connections.

The invention claimed is:

1. An apparatus for transfer of a fluid between a vessel for transport of the fluid and a storage station, comprising:

a tubular arrangement for conveying the fluid between the transport vessel and the storage station, having a first end connected to the storage station, a second end which can be connected to a manifold of the transport vessel, a flexible transfer conduit freely suspended to extend in a substantially vertical plane, between the first and second ends, in a transfer position, connected to manifold device of transport vessel, and, at each of the first and second ends, a rotating connection with a respective vertical axis for preventing torsional and bending stresses in the flexible transfer conduit, wherein rotation of the rotating connections about each vertical axis compensates for bending stresses exerted on the conduit in a direction perpendicular to the plane.

2. The apparatus according to claim 1, wherein the flexible transfer conduit is a hose for transfer of liquefied natural gas.

3. The apparatus according to claim 1, wherein the flexible transfer conduit includes a sequence of elements articulated to one another.

4. The apparatus according to claim 1, wherein the flexible transfer conduit is suspended as a catenary.

5. The apparatus according to claim 1, wherein the manifold comprises a portion including, at a free end, a manifold flange for connection of a connecting endpiece of the flexible transfer conduit, and the portion of the manifold device at another end is connected by the rotating connection with a vertical axis to a fixed pipeline of the transport vessel.

6. The apparatus according to claim 5, wherein the connecting endpiece of the flexible transfer conduit includes a pin, and the manifold includes a tubular piece for reception of the pin during connection of the flexible transfer conduit to the manifold and including a winch on which can be wound a cable, which, when attached to the pin, ensures the connection of the pin and the tubular piece by guiding engagement of the pin and the tubular piece.

7. The apparatus according to claim 5, wherein the manifold has a curved part that includes a pin, and a connecting endpiece of the flexible transfer conduit includes a flared piece for reception of the pin during connection of the endpiece to the manifold and includes a winch on which can be wound a cable which, when attached to the pin during establishment of a connection ensures guided engagement of the pin in the flared piece.

8. The apparatus according to claim 6, wherein the manifold is mounted on a support structure including catwalks for handling of the manifold and having a passage for a free end of the manifold or for connecting the endpiece of the flexible transfer conduit during connection of the endpiece to the manifold.

9. An apparatus for transfer of a fluid between a vessel for transport of the fluid and a storage station comprising:

a tubular arrangement for conveying the fluid between the transport vessel and the storage station, having a first end which can be connected to the storage station;

a second end which can be connected to a manifold of the transport vessel;

a flexible transfer conduit freely suspended to extend in a substantially vertical plane, between the first and second ends, in a transfer position, connected to a manifold device of transport vessel;

a first rotating connection with a vertical axis, provided on the storage station, at the first end;

a second rotating connection with a vertical axis, provided in the manifold, at the second end, wherein the first and second rotating connections prevent torsional and bending stresses in the conduit; and a storage wheel, on which the flexible transfer conduit can be wound, located on the storage station.

10. An apparatus for transfer of a fluid between a vessel for transport of the fluid and a storage station comprising:

a tubular arrangement for conveying the fluid between the transport vessel and the storage station, having a first end which can be connected to the storage station;

a second end which can be connected to a manifold of the transport vessel;

a flexible transfer conduit freely suspended to extend in a substantially vertical plane, between the first and second ends, in a transfer position, connected to a manifold device of transport vessel;

a first rotating connection with a vertical axis, provided on the storage station, at the first end;

a second rotating connection with a vertical axis, integrated into the manifold, at the second end, wherein the first and second rotating connections prevent torsional and bending stresses in the flexible transfer conduit so that rotation of the connections about each vertical axis compensates for bending stresses exerted on the flexible transfer conduit in a direction perpendicular to the vertical plane; and a storage wheel, on which the flexible transfer conduit can be wound, connected to the storage station at the first rotating connection, wherein the wheel rotates about a horizontal axis.

11. An apparatus for transfer of a fluid between a vessel for transport of the fluid and a storage station comprising:

a tubular arrangement for conveying the fluid between the transport vessel and the storage station, having a first end which can be connected to the storage station;

a second end which can be connected to a manifold of the transport vessel;

two flexible transfer conduits, wherein at least one flexible transfer conduit is freely suspended to extend in a substantially vertical plane, between the first and second ends, in a transfer position, connected to a manifold device of transport vessel, and each flexible transfer conduit is stored on a storage wheel for connection to the manifold;

a first rotating connection with a vertical axis at the first end;

a second rotating connection with a vertical axis at the second end, wherein the first and second rotating connections prevent torsional and bending stresses in the flexible transfer conduits so that rotation of the connections about each vertical axis compensates for bending stresses exerted on the flexible transfer conduits in a direction perpendicular to the vertical plane and the storage wheels and the manifold include a rotating connection with a vertical axis and are arranged symmetrically with respect to the axis of a corresponding vessel.

12. The apparatus according to claim 1, wherein the first and second rotating connections with the vertical axes at respective ends rotate coaxially with the vertical axes.

13. The apparatus according to claim 1, wherein the first and second rotating connections with the vertical axes at respective ends always extend the flexible transfer conduit approximately in the vertical plane.

14. The apparatus according to claim 1, wherein the first and second rotating connection with the vertical axes at respective ends extend the flexible transfer conduit in the vertical plane independently of an angle of misalignment between the transport vessel and the storage station.

15. The apparatus according to claim 1, wherein the first and second rotating connections with the vertical axes at respective ends exerts no torsion or bending from the vertical plane of the flexible transfer conduit.

* * * * *